US009879646B2

(12) United States Patent
Hirata

(10) Patent No.: US 9,879,646 B2
(45) Date of Patent: Jan. 30, 2018

(54) CERAMIC GLOW PLUG

(71) Applicant: NGK SPARK PLUG CO., LTD., Nagoya-shi, Aichi (JP)

(72) Inventor: Takashi Hirata, Kasugai (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 590 days.

(21) Appl. No.: 14/374,359

(22) PCT Filed: Feb. 1, 2013

(86) PCT No.: PCT/JP2013/000571
§ 371 (c)(1),
(2) Date: Jul. 24, 2014

(87) PCT Pub. No.: WO2013/136658
PCT Pub. Date: Sep. 19, 2013

(65) Prior Publication Data

US 2014/0373800 A1 Dec. 25, 2014

(30) Foreign Application Priority Data

Mar. 12, 2012 (JP) ..... 2012-054278

(51) Int. Cl.
*F23Q 7/22* (2006.01)
*F02P 19/02* (2006.01)
(Continued)

(52) U.S. Cl.
CPC ..... *F02P 19/02* (2013.01); *F23Q 7/001* (2013.01); *H05B 3/48* (2013.01); *H05B 2203/027* (2013.01)

(58) Field of Classification Search
CPC . F23Q 7/001; F02P 19/02; H05B 3/48; H05B 2203/027
See application file for complete search history.

(56) References Cited

U.S. PATENT DOCUMENTS

2004/0124754 A1* 7/2004 Yoshikawa ..... F23Q 7/001 313/118

FOREIGN PATENT DOCUMENTS

JP 2002-364842 A 12/2002
JP 2002-364845 A 12/2002
(Continued)

OTHER PUBLICATIONS

Communication dated Apr. 20, 2016 from Korean Intellectual Property Office in counterpart Application No. 10-2014-7022974.
(Continued)

*Primary Examiner* — Shawntina Fuqua
(74) *Attorney, Agent, or Firm* — Sughrue Mion, PLLC

(57) ABSTRACT

A ceramic glow plug includes a ceramic heater; a tubular sleeve which holds the outer circumference of the ceramic heater with a front end portion thereof protruding from the front end of the sleeve; and a tubular housing which surrounds a rear end portion of the ceramic heater and has a mounting portion for mounting the housing. The sleeve has a small-diameter portion which is accommodated in a front end portion of the housing and has an outer diameter smaller than the inner diameter of the front end portion of the housing, and a large-diameter portion which is connected to the small-diameter portion, disposed frontward of the front end portion of the housing, and has a diameter larger than the inner diameter of the front end portion of the housing. The front end portion of the housing is welded to the large-diameter portion.

7 Claims, 2 Drawing Sheets

(51) Int. Cl.
*F23Q 7/00* (2006.01)
*H05B 3/48* (2006.01)

(56) References Cited

FOREIGN PATENT DOCUMENTS

| | | | |
|---|---|---|---|
| JP | 2004-205148 | A | 7/2004 |
| JP | 2008-8607 | A | 1/2008 |
| JP | 2010-127476 | A | 6/2010 |
| JP | 2011-144978 | A | 7/2011 |

OTHER PUBLICATIONS

Communication dated Oct. 22, 2015 from the Korean Intellectual Property Office in counterpart application No. 10-2014-7022974.
International Search Report for PCT/JP2013/000571 dated Apr. 16, 2013 [PCT/ISA/210].

* cited by examiner

CERAMIC GLOW PLUG

CROSS REFERENCE TO RELATED APPLICATIONS

This application is a National Stage of International Application No. PCT/JP2013/000571, filed on Feb. 1, 2013, which claims priority from Japanese Patent Application No. 2012-054278, filed on Mar. 12, 2012, the contents of all of which are incorporated herein by reference in their entirety.

TECHNICAL FIELD

The present invention relates to a ceramic glow plug used for, for example, pre-heating of a diesel engine.

BACKGROUND ART

Glow plugs have been conventionally used for, for example, pre-heating of diesel engines. A ceramic glow plug including a ceramic heater used as the heater for heating is also used as such a glow plug.

In the above ceramic glow plug, the ceramic heater includes a base formed of an insulating ceramic, and a heater element formed of a conductive ceramic and embedded in the base. The ceramic heater is held in a metal sleeve formed into a tubular shape, and the sleeve is united with a cylindrical tubular metal housing by being press-fitted into a front end portion of the housing. The housing has on its outer circumferential surface a threaded portion to be screwed into a mounting hole of an internal combustion engine.

Also, there has been known a ceramic glow plug whose sleeve has a small-diameter portion located at its rear end, and a large-diameter portion located frontward of the small-diameter portion and having a diameter larger than that of the small-diameter portion (see, for example, Patent Document 1). The small-diameter portion is press-fitted into a front end portion of the housing, and a part of the large-diameter portion and a part of the front end portion of the housing, which parts are in contact with each other, are externally welded and joined together for reinforcement.

PRIOR ART DOCUMENT

Patent Document

Patent Document 1: Japanese Patent Application Laid-Open (kokai) No. 2004-205148

SUMMARY OF THE INVENTION

Problem to be Solved by the Invention

The conventional ceramic glow plug described above has a structure in which the sleeve is press-fitted into the front end portion of the housing. Therefore, the ceramic heater receives the pressure (contact pressure) which the sleeve exerts on the ceramic heater so as to hold the ceramic heater and also receives the contact pressure which the sleeve receives from the housing when the sleeve is press-fitted into the housing. The contact pressure received by the ceramic heater may become excessively large, depending on the dimensions of the housing or the characteristics of the material of the housing. In such a case, there arises a problem in that, when the ceramic glow plug receives a strong shock from a diesel engine and stress is thereby generated, the stress is superimposed on the contact pressure acting on the ceramic heater from the beginning, so that the ceramic heater is likely to break.

The present invention has been made in view of the above-described conventional circumstances, and its object is to provide a ceramic glow plug including a ceramic heater having improved shock resistance as compared with the conventional ceramic glow plug.

Means for Solving the Problem

One mode of a ceramic glow plug according to the present invention is a ceramic glow plug comprising a ceramic heater including a base formed of an insulating ceramic and a heater element formed of a conductive ceramic and embedded in the base, the ceramic heater extending in an axial direction; a tubular sleeve which holds, on an inner circumference thereof, an outer circumference of the ceramic heater with a front end portion of the ceramic heater protruding from a front end of the sleeve; and a tubular housing which surrounds a rear end portion of the ceramic heater and has a mounting portion for mounting the housing to a mounting hole of an internal combustion engine, the ceramic glow plug being characterized in that the sleeve includes a small-diameter portion which is accommodated in a front end portion of the housing and has an outer diameter smaller than an inner diameter of the front end portion of the housing, and a large-diameter portion which is connected to the small-diameter portion, is disposed frontward of the front end portion of the housing, and has a diameter larger than the inner diameter of the front end portion of the housing, and that the front end portion of the housing is welded to the large-diameter portion.

In the ceramic glow plug of the present invention, the sleeve includes the small-diameter portion accommodated in the front end portion of the housing and having an outer diameter smaller than the inner diameter of the front end portion of the housing; and the large-diameter portion connected to the small-diameter portion, disposed frontward of the front end portion of the housing, and having a diameter larger than the inner diameter of the front end portion of the housing. More specifically, the small-diameter portion is not press-fitted into the front end portion of the housing. Therefore, the ceramic heater receives only the contact pressure which the sleeve exerts thereon and does not receive the contact pressure which the sleeve receives from the housing. By virtue of this configuration, the ceramic heater becomes less likely to break (i.e., the ceramic heater has improved shock resistance) as compared with a ceramic glow plug in which contact pressure acts on a ceramic heater as a result of press-fitting of the small-diameter portion into the front end portion of the housing.

Since the small-diameter portion is not press-fitted into the housing, there may be contemplated use of a configuration with no small-diameter portion. However, with the configuration in which the small-diameter portion not press-fitted into the front end portion of the housing is disposed rearward of the large-diameter portion of the sleeve, the shock resistance of the ceramic heater can be improved. More specifically, if the configuration with no small-diameter portion is used, the contact pressure acting on the ceramic heater from the sleeve is received by a portion of the ceramic heater which is accommodated in the large-diameter portion, and a portion of the ceramic heater which is located rearward of the accommodated portion and is not accommodated in the large-diameter portion receives almost no contact pressure, so that the contact pressure varies greatly at a portion corresponding to the rear end surface of the large-diameter portion (this portion is hereinafter referred to as a boundary portion). Therefore, when a shock is applied, stress is concentrated on the boundary portion between the portion of the ceramic heater accommodated in the large-diameter portion and the portion of the ceramic heater located rearward of the accommodated portion and not accommodated in the large-diameter portion, so that the ceramic heater easily breaks at the boundary portion.

In contrast, with the configuration in which the small-diameter portion is disposed rearward of the large-diameter portion, the contact pressure acting on the ceramic heater from the sleeve gradually decreases from the large-diameter portion toward the small-diameter portion. Therefore, the difference in contact pressure at a second boundary portion between a portion of the ceramic heater which is accommodated in the small-diameter portion and a portion of the ceramic heater which is located rearward of the accommodated portion and is not accommodated in the small-diameter portion can be reduced, so that stress applied to the second boundary portion when a shock is applied can be reduced. Therefore, the shock resistance can be improved.

The ceramic glow plug of the present invention may be configured such that the ceramic heater is press-fitted into and held by the sleeve. This allows the ceramic heater to be firmly held by the sleeve.

When the ceramic heater is press-fitted into and held by the sleeve, a larger contact pressure is exerted on the ceramic heater by the sleeve, so that the ceramic heater tends to more easily break when a strong shock is applied. In contrast, in the present invention, the small-diameter portion of the sleeve is not press-fitted into the front end portion of the housing, so that the ceramic heater receives only the contact pressure which the sleeve exerts thereon and does not receive the contact pressure which the sleeve receives from the housing. Therefore, even when a larger contact pressure is exerted on the ceramic heater by the sleeve, the shock resistance can be maintained.

The ceramic glow plug of the present invention may be configured such that a gap is formed between an outer circumferential surface of the small-diameter portion and an inner circumferential surface of the front end portion of the housing to extend over the entire circumference. With this configuration, misalignment (deflection of the axis) between the sleeve and the housing can be suppressed, and their coaxiality can thereby be improved. More specifically, in a configuration in which the small-diameter portion is press-fitted into the front end portion of the housing, the sleeve may be inserted obliquely into the housing during press-fitting, and the dimensional errors of the components may directly cause misalignment. In contrast, when the small-diameter portion is configured such that a gap is formed between an outer circumferential surface of the small-diameter portion and an inner circumferential surface of the front end portion of the housing to extend over the entire circumference, the sleeve is prevented from being inserted obliquely into the housing during press-fitting. In addition, even when the components have dimensional errors, the misalignment can be suppressed by aligning the housing and the sleeve before welding, so that the coaxiality can be improved irrespective of the dimensional errors of the components.

The ceramic glow plug of the present invention may be configured such that a tapered portion is formed at a rear end portion of the small-diameter portion such that its diameter gradually decreases toward a rear side in the axial direction. In this configuration, the thickness of the sleeve decreases gradually from the front side toward the rear side in the small-diameter portion as well, so that the difference in contact pressure at the second boundary portion between the portion of the ceramic heater which is accommodated in the sleeve and the portion of the ceramic heater which is located rearward of the accommodated portion and is not accommodated in the sleeve can be further reduced. Therefore, the stress applied to the second boundary portion when a shock is applied can be further reduced, and the shock resistance can be further improved. When the tapered portion is disposed, the small-diameter portion can be more easily inserted into the front end portion of the housing as compared with the case in which no tapered portion is provided.

Advantageous Effects of the Invention

The present invention can provide a ceramic glow plug including a ceramic heater having improved shock resistance as compared with conventional ceramic glow plugs.

MODES FOR CARRYING OUT THE INVENTION

An embodiment of the present invention will next be described with reference to the drawings.

Figure 1:
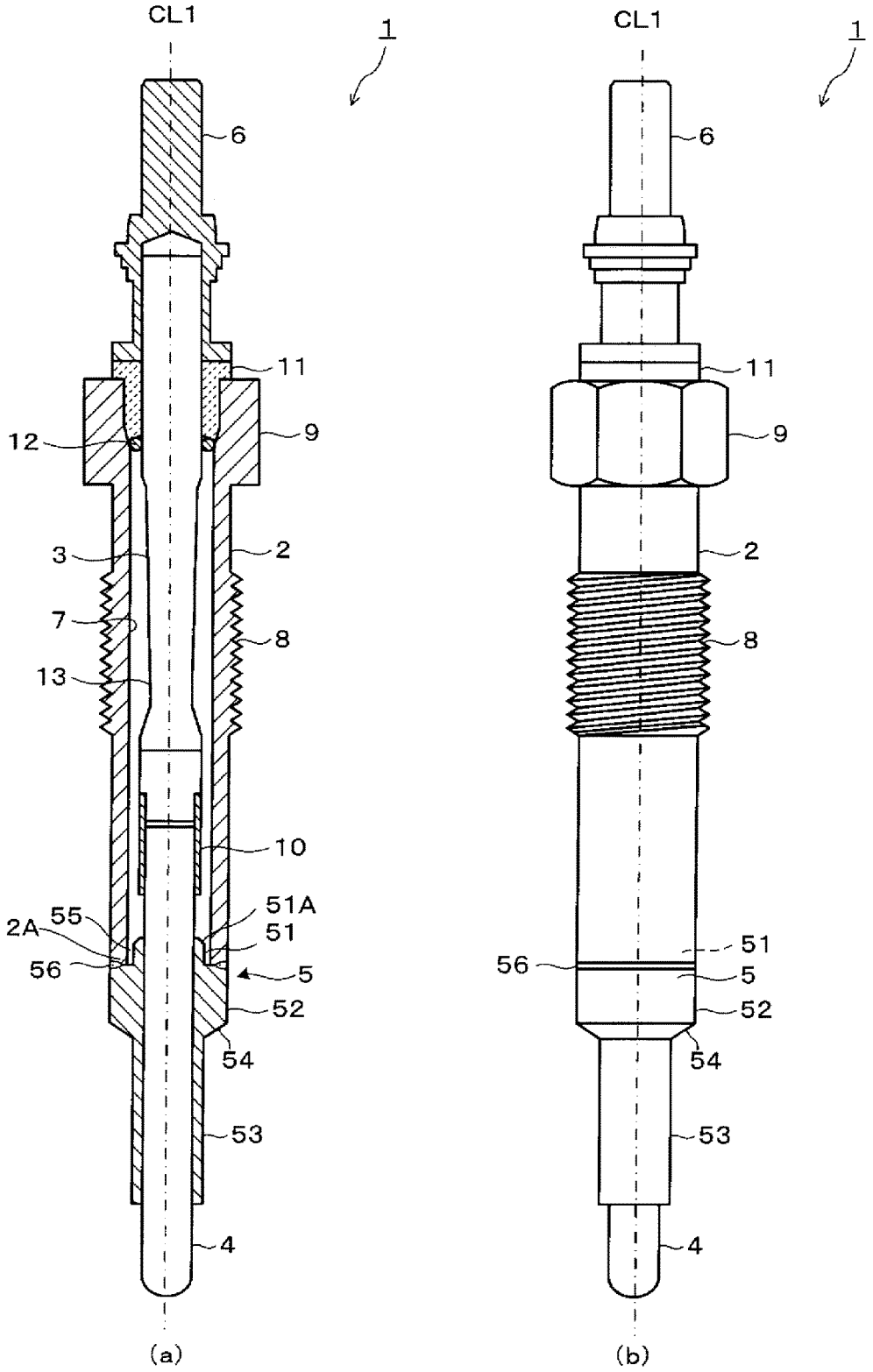
FIG. 1(*a*) is a cross-sectional view illustrating the configuration of a glow plug according to an embodiment of the present invention, and FIG. 1(*b*) is a front view of the glow plug.
Figure 2:
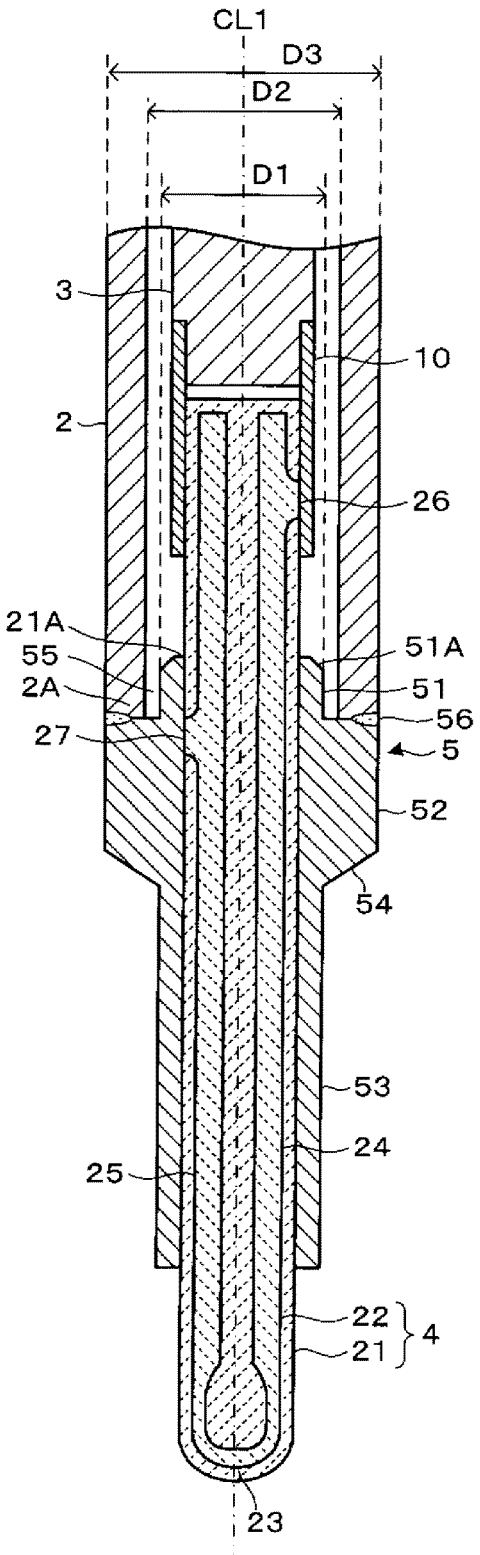
FIG. 2 is an enlarged partial cross-sectional view illustrating the front end portion of the glow plug in FIGS. 1(*a*) and 1(*b*).

FIGS. 1(*a*) and 1(*b*) schematically show the configuration of a ceramic glow plug according to an embodiment of the present invention, FIG. 1(*a*) showing a vertical cross-sectional configuration of the ceramic glow plug 1, FIG. 1(*b*) showing the external configuration of the ceramic glow plug 1. FIG. 2 is an enlarged partial cross-sectional view mainly illustrating a ceramic heater 4. In the following description, the lower side in FIGS. 1(*a*) to 2 is referred to as the front side of the ceramic glow plug 1 in a direction of axis CL1, and the upper side is referred to as the rear side.

As shown in FIGS. 1(*a*) and 1(*b*), the ceramic glow plug 1 includes a housing 2, a center rod 3, a ceramic heater 4, a sleeve 5, a terminal pin 6, etc.

The housing 2 is formed of a prescribed metal material (e.g., an iron-based material such as stainless steel or carbon steel, for example, S45C) and has an axial bore 7 extending in the direction of the axis CL1. A threaded portion 8 (corresponding to a mounting portion in claims) for mounting the ceramic glow plug 1 to a mounting hole of an internal combustion engine is formed on the outer circumference of a lengthwise central portion of the housing 2. A flange-shaped tool engagement portion 9 having a hexagonal cross sectional shape is formed on the outer circumference of a rear end portion of the housing 2, and a tool such as a hexagonal wrench is engaged with the tool engagement portion 9 when the glow plug 1 (the threaded portion 8) is attached to an internal combustion engine.

The center rod 3 formed of a metal and having the shape of a round bar is accommodated within the axial bore 7 of the housing 2 so as to be spaced apart from the inner circumferential surface of the housing 2. A front end portion of the center rod 3 is press-fitted into a rear end portion of a cylindrical tubular connection member 10 formed of a metal material (e.g., an iron-based material such as SUS). A rear end portion of the ceramic heater 4 is press-fitted into a front end portion of the connection member 10. In this manner, the center rod 3 and the ceramic heater 4 are mechanically and electrically connected through the connection member 10. The center rod 3 has, on its front side, a constricted portion 13 formed such that its diameter decreases frontward. The constricted portion 13 enables, for example, relaxation of stress transmitted to the center rod 3.

The metal-made terminal pin 6 is fixed to a rear end portion of the center rod 3 by means of crimping. To prevent direct electrical continuity between a front end portion of the terminal pin 6 and a rear end portion of the housing 2, an insulating bushing 11 formed of an insulating material is disposed therebetween. To improve, for example, the airtightness of the axial bore 7, an O-ring 12 formed of an insulating material is disposed between the housing 2 and the center rod 3 so as to be in contact with a front end portion of the insulating bushing 11.

The sleeve 5 is formed of a metal such as stainless steel into a tubular shape. The ceramic heater 4 is press-fitted into the sleeve 5, and an intermediate portion (with respect to the direction of the axis CL1) of the outer circumferential surface of the ceramic heater 4 is held by the inner circumference of the sleeve 5. A front end portion of the ceramic heater 4 protrudes from the front end of the sleeve 5, and a rear end portion of the ceramic heater 4 is inserted into the axial bore 7 of the housing 2 and protrudes from the rear end of the sleeve 5.

The sleeve 5 includes a small-diameter portion 51 having a relatively small diameter and located at the rear end of the sleeve 5, a large-diameter portion 52 having an outer diameter larger than the outer diameter of the small-diameter portion 51 and located frontward of the small-diameter portion 51, and a front-side small-diameter portion 53 having an outer diameter smaller than the outer diameter of the large-diameter portion 52 and located frontward of the large-diameter portion 52. A press-contact portion 54 tapered toward the front side is formed between the large-diameter portion 52 and the front-side small-diameter portion 53. When the ceramic glow plug 1 is mounted to a mounting hole of an internal combustion engine, the press-contact portion 54 abuts against a receiving surface of the mounting hole, so that the airtightness of the internal combustion engine is ensured. A tapered portion 51A is formed at a rear end portion of the small-diameter portion 51.

As shown in FIG. 2, the outer diameter D1 of the small-diameter portion 51 is smaller than the inner diameter D2 of a front end portion 2A of the housing 2, and the small-diameter portion 51 is not press-fitted into the front end portion 2A of the housing 2 even when inserted into the axial bore 7 of the housing 2 (even when disposed within the front end portion 2A of the housing 2). In the present embodiment, the inner diameter of the axial bore 7 of the housing 2 is constant not only at the front end portion 2A but also over the entire length of the axial bore 7. In the present embodiment, a gap 55 is formed between the outer circumferential surface of the small-diameter portion 51 and the inner circumferential surface of the front end portion 2A of the housing 2 to extend over the entire circumference.

As shown in FIG. 2, the outer diameter D3 of the large-diameter portion 52 is larger than the inner diameter D2 of the front end portion 2A of the housing 2, and the front end portion 2A of the housing 2 (specifically, the front end surface of the housing 2) and the large-diameter portion 52 (specifically, the rear end surface of the large-diameter portion 52) abut against each other. In the present embodiment, the outer diameter D3 of the large-diameter portion 52 is substantially the same as the outer diameter of the front end portion 2A of the housing 2. With the small-diameter portion 51 inserted into the axial bore 7 of the housing 2, the front end portion 2A of the housing 2 and the large-diameter portion 52 are welded, e.g., laser-welded, over their entire circumference, whereby a welded portion 56 is formed.

As described above, in the present embodiment, the small-diameter portion 51 of the sleeve 5 is not press-fitted into the front end portion 2A of the housing 2. Therefore, the ceramic heater 4 receives only the contact pressure which the sleeve 5 exerts thereon and does not receive the contact pressure which the sleeve 5 receives from the housing 2 (in the present embodiment, the housing 2 applies no pressure to the sleeve 5). Therefore, the ceramic heater 4 is less likely to break as compared with the configuration in which the ceramic heater 4 receives the contact pressure as a result of press-fitting of the small-diameter portion 51 into the front end portion 2A of the housing 2, so that the shock resistance of the ceramic heater 4 can be improved. Such an effect can be obtained when the outer diameter D1 of the small-diameter portion 51 is smaller than the inner diameter D2 of the front end portion 2A of the housing 2 and the small-diameter portion 51 is not press-fitted into the front end portion 2A of the housing 2. Therefore, the gap 55 is not necessarily required to be formed over the entire circumference as in the present embodiment.

In the present embodiment, since the small-diameter portion 51 is not press-fitted into the housing 2, the small-diameter portion 51 may be omitted. However, with the configuration in which the small-diameter portion 51 not press-fitted into the front end portion 2A of the housing 2 is disposed rearward of the large-diameter portion 52 of the sleeve 5, the shock resistance of the ceramic heater 4 can be improved. More specifically, if the configuration with no small-diameter portion 51 is used, the contact pressure acting on the ceramic heater 4 from the sleeve 5 is received by a portion of the ceramic heater 4 which is accommodated in the large-diameter portion 52, but a portion of the ceramic heater 4 which is located rearward of the accommodated portion and is not accommodated in the large-diameter portion 52 receives almost no contact pressure, so that the contact pressure varies greatly at a boundary portion corresponding to the rear end surface of the large-diameter portion 52. Therefore, when a shock is applied, stress is concentrated on the boundary portion between the portion of the ceramic heater 4 which is accommodated in the large-diameter portion 52 and the portion of the ceramic heater 4 which is located rearward of the accommodated portion and is not accommodated in the large-diameter portion 52, so that the ceramic heater 4 easily breaks at the boundary portion.

However, with the configuration in which the small-diameter portion 51 is disposed rearward of the large-diameter portion 52, the contact pressure acting on the ceramic heater 4 from the sleeve 5 gradually decreases. Therefore, the difference in contact pressure at a second boundary portion 21A between a portion of the ceramic heater 4 which is accommodated in the small-diameter portion 51 and a portion of the ceramic heater 4 which is located rearward of the accommodated portion and is not accommodated in the small-diameter portion 51 can be reduced, so that the stress applied to the second boundary portion 21A when a shock is applied can be reduced. Therefore, the shock resistance can be improved.

In the configuration of the present embodiment, the ceramic heater 4 is press-fitted into and held by the sleeve 5. This allows the ceramic heater 4 to be firmly held by the sleeve 5.

When the ceramic heater 4 is press-fitted into and held by the sleeve 5, a larger contact pressure is exerted on the ceramic heater 4 by the sleeve 5, so that the ceramic heater 4 tends to more easily break when a strong shock is applied. In contrast, in the present embodiment, the small-diameter portion 51 of the sleeve 5 is not press-fitted into the front end portion 2A of the housing 2, so that the ceramic heater 4 receives only the contact pressure which the sleeve 5 exerts thereon and does not receive the contact pressure which the sleeve 5 receives from the housing 2. Therefore, even when a larger contact pressure is exerted on the ceramic heater 4 by the sleeve 5, the shock resistance can be maintained.

In the present embodiment, the tapered portion 51A is formed at the rear end portion of the small-diameter portion 51. Therefore, the thickness of the sleeve 5 decreases gradually from the front side toward the rear side in the small-diameter portion 51 as well, so that the difference in contact pressure at the second boundary portion 21A between the portion of the ceramic heater 4 which is accommodated in the sleeve 5 and the portion of the ceramic heater 4 which is located rearward of the accommodated portion and is not accommodated in the sleeve 5 can be further reduced. Therefore, the stress applied to the boundary portion when a shock is applied can be further reduced. When the tapered portion 51A is disposed, the small-diameter portion 51 can be more easily inserted into the front end portion 2A of the housing 2 as compared with the case in which the tapered portion 51A is not provided.

In the configuration of the present embodiment, the outer diameter D1 of the small-diameter portion 51 is smaller than the inner diameter D2 of the axial bore 7 of the housing 2. In addition, the gap 55 is formed between the outer circumferential surface of the small-diameter portion 51 and the inner circumferential surface of the front end portion 2A of the housing 2 such that the gap 55 extends over the entire circumference. This can prevent the misalignment between the housing 2 and the sleeve 5, and their coaxiality is thereby improved. More specifically, in a configuration in which the small-diameter portion 51 is press-fitted into the front end portion 2A of the housing 2, the sleeve 5 may be inserted obliquely into the housing 2 during press-fitting, and the dimensional errors of the components may directly cause misalignment. In contrast, in the present embodiment, the sleeve 5 is not inserted obliquely into the housing 2, which oblique insertion would otherwise occur as a result of press-fitting. In addition, even when the components have dimensional errors, the misalignment can be suppressed by aligning the housing 2 and the sleeve 5 before welding, so that the coaxiality can be improved irrespective of the dimensional errors of the components.

Next, the ceramic heater 4, which is well known, will be described. As shown in FIG. 2, the ceramic heater 4 includes a tubular base 21 formed of an insulating ceramic (e.g., ceramic whose predominant component is silicon nitride) and extending in the direction of the axis CL1; and an elongated U-shaped heater element 22 embedded in the base 21 and formed of a conductive ceramic. The base 21 is formed so as to have a substantially uniform outer diameter except for its front end portion. The heater element 22 includes a heat generation section 23 and a pair of rod-shaped lead sections 24 and 25 joined to opposite end portions of the heat generation section 23. The heat generation section 23 is a portion functioning as a so-called heat-generating resistor, and is disposed at the front end portion of the ceramic heater 4, which front end portion is formed to have a curved surface. The heat generation section 23 has a generally U-shaped cross section extending along the curved surface. In the present embodiment, the cross-sectional area of the heat generation section 23 is smaller than the cross-sectional areas of the lead sections 24 and 25, and the (electric) resistivity of the conductive ceramic forming the heat generation section 23 is larger than the resistivity of the conductive ceramic forming the lead sections 24 and 25. Therefore, heat is generated intensively in the heat generation section 23 when it is energized.

The lead sections 24 and 25 extend toward the rear end of the ceramic heater 4 such that they become substantially parallel to each other. The lead section 24 has an electrode terminal portion 26 provided at a rear end portion thereof and protruding toward the outer circumference of the ceramic heater 4. The electrode terminal portion 26 is exposed at the outer circumferential surface of the ceramic heater 4. Similarly, the lead section 25 has an electrode terminal portion 27 protruding toward the circumference of the ceramic heater 4. The electrode terminal portion 27 is exposed at the outer circumferential surface of the ceramic heater 4. The electrode terminal portion 26 of the lead section 24 is formed rearward of the electrode terminal portion 27 of the lead section 25 in the direction of the axis CL1.

The exposed part of the electrode terminal portion 26 is in contact with the inner circumferential surface of the connection member 10, and therefore the center rod 3 connected to the connection member 10 is electrically connected to the lead section 24. The exposed part of the electrode terminal portion 27 is in contact with the inner circumferential surface of the sleeve 5, and therefore the housing 2 joined to the sleeve 5 is electrically connected to the lead section 25. In this configuration, the center rod 3 and the housing 2 function as positive and negative electrodes for energizing the heat generation section 23 of the ceramic heater 4.

A ceramic glow plug 1 (Example) that had the structure shown in FIGS. 1(*a*) to 2 was produced, and the finished product was dropped from heights of 0.5 m and 1.0 m above a reference plane using a drop tester so as to test its shock resistance. The results showed that the ceramic heater 4 did not break even when dropped from a height of 0.5 m and also from a height of 1.0 m.

A ceramic glow plug (Comparative Example) was produced such that the outer diameter D1 of the small-diameter portion 51 of the sleeve 5 was larger than the inner diameter D2 of the front end portion 2A of the housing 2 and the small-diameter portion 51 was press-fitted into the front end portion 2A of the housing 2. The finished product was dropped from heights of 0.5 m and 1.0 m above the reference plane using the drop tester so as to test its shock resistance. The results showed that, although the ceramic heater did not break when dropped from a height of 0.5 m, the ceramic heater did not break when dropped from a height of 1.0 m.

As can be seen from the above results, the shock resistance of Example was higher than that of Comparative Example.

Next, 15 ceramic glow plugs 1 (Examples) that had the structure shown in FIGS. 1(*a*) to 2 were produced. For each ceramic glow plug 1, the coaxiality between the outer circumferential surface of the housing 2 and the outer circumferential surface of the large-diameter portion 52 of the sleeve 5 was determined. The coaxiality was determined by measuring the position of the outer circumferential surface of the housing 2 and the position of the outer circumferential surface of the large-diameter portion 52 of the sleeve 5 while the ceramic glow plug 1 was rotated.

In addition, 15 ceramic glow plugs (Comparative Examples) were produced such that the outer diameter D1 of the small-diameter portion 51 of the sleeve 5 was larger than the inner diameter D2 of the front end portion 2A of the housing 2 and the small-diameter portion 51 was press-fitted into the front end portion 2A of the housing 2. The coaxiality of each ceramic glow plug was determined in the same manner as in the case of the ceramic glow plugs of Examples. The results are shown in TABLE 1. The values of the coaxiality in TABLE 1 are the absolute values of "the position of the housing—the position of the large-diameter portion."

TABLE 1

| | Examples (mm) | Comparative Examples (mm) |
|---|---|---|
| 1 | 0.05 | 0.17 |
| 2 | 0.04 | 0.08 |
| 3 | 0.02 | 0.14 |
| 4 | 0.04 | 0.05 |
| 5 | 0.04 | 0.06 |
| 6 | 0.06 | 0.21 |
| 7 | 0.04 | 0.07 |
| 8 | 0.04 | 0.13 |
| 9 | 0.02 | 0.19 |
| 10 | 0.02 | 0.03 |
| 11 | 0.02 | 0.15 |
| 12 | 0.01 | 0.19 |
| 13 | 0.02 | 0.09 |
| 14 | 0.04 | 0.04 |
| 15 | 0.03 | 0.11 |
| Average value | 0.03 | 0.12 |
| Maximum value | 0.06 | 0.21 |
| Minimum value | 0.01 | 0.04 |
| σ | 0.01 | 0.06 |

As shown in TABLE 1, the average of the measured values of coaxiality of Examples was 0.03 mm, the maximum value of coaxiality was 0.06 mm, the minimum value of coaxiality was 0.01 mm, and σ was 0.01 mm.

The average of the measured values of coaxiality of Comparative Examples was 0.12 mm, the maximum value of coaxiality was 0.21 mm, the minimum value of coaxiality was 0.04 mm, and σ was 0.06 mm.

As can be seen from the above results, Examples were higher in coaxiality than Comparative Examples and were smaller in coaxiality variation than Comparative Examples.

The present invention has been described with reference to the embodiment and examples. However, the present invention is not limited to the embodiment and examples described above, and needless to say, various modifications are possible.

INDUSTRIAL APPLICABILITY

The ceramic glow plug of the present invention can be used in the field of ceramic glow plugs used in internal combustion engines such as engines for automobiles and in other fields. Therefore, the ceramic glow plug has industrial applicability.

DESCRIPTION OF REFERENCE NUMERALS

1: ceramic glow plug
2: housing
3: center rod
4: ceramic heater
5: sleeve
51: small-diameter portion
51A: tapered portion
52: large-diameter portion
53: front-side small-diameter portion
54: press-contact portion
55: gap
56: welded portion
7: axial bore
8: threaded portion
21: base
22: heater element
CL1: axis

The invention claimed is:

1. A ceramic glow plug comprising:

a ceramic heater including a base formed of an insulating ceramic and a heater element formed of a conductive ceramic and embedded in the base, the ceramic heater extending in an axial direction;

a tubular sleeve which holds, on an inner circumference thereof, an outer circumference of the ceramic heater with a front end portion of the ceramic heater protruding from a front end of the sleeve; and a tubular housing which surrounds a rear end portion of the ceramic heater and has a mounting portion for mounting the housing to a mounting hole of an internal combustion engine, the ceramic glow plug being characterized in that the sleeve includes a small-diameter portion which is accommodated in a front end portion of the housing and has an outer diameter smaller than an inner diameter of the front end portion of the housing, and a large-diameter portion which is connected to the small-diameter portion, is disposed frontward of the front end portion of the housing, and has a diameter larger than the inner diameter of the front end portion of the housing, and that the front end portion of the housing is welded to the large-diameter portion, and a length in the axial direction of the large-diameter portion is larger than a length in the axial direction of the small-diameter portion.

2. A ceramic glow plug according to claim 1, wherein the sleeve is not press-fitted into the housing.

3. A ceramic glow plug according to claim 1, wherein the large-diameter portion and the small-diameter portion are connected directly to each other, and the front end portion of the housing is welded to the large-diameter portion in a state in which a front end surface of the front end portion of the housing is in contact with a rearward-facing surface of the large-diameter portion.

4. A ceramic glow plug according to claim 1, wherein the ceramic heater is press-fitted into and held by the sleeve.

5. A ceramic glow plug according to claim 1, wherein a gap is formed between an outer circumferential surface of the small-diameter portion and an inner circumferential surface of the front end portion of the housing such that the gap extends over the entire circumference.

6. A ceramic glow plug according to claim 1, wherein a tapered portion is formed at a rear end portion of the small-diameter portion such that its diameter gradually decreases toward a rear side in the axial direction.

7. A ceramic glow plug according to claim 1, wherein a press-contact portion tapered toward the front side and connected to the large-diameter portion is provided in the sleeve.

* * * * *